United States Patent [19]

Nemit et al.

[11] 4,254,386

[45] Mar. 3, 1981

[54] THREE-WAY, EQUAL-PHASE COMBINER/DIVIDER NETWORK ADAPTED FOR EXTERNAL ISOLATION RESISTORS

[75] Inventors: Jeffrey T. Nemit, Canoga Park; Bobby J. Sanders, Pacoima, both of Calif.

[73] Assignee: International Telephone and Telegraph Corporation, New York, N.Y.

[21] Appl. No.: 84,862

[22] Filed: Oct. 15, 1979

[51] Int. Cl.[3] ..... H01P 5/12

[52] U.S. Cl. ..... 333/128; 333/136; 333/238

[58] Field of Search ..... 333/120, 125, 127, 128, 333/136, 137

[56] References Cited

U.S. PATENT DOCUMENTS 3,904,990 9/1975 LaRosa ..... 333/128

*Primary Examiner*—Paul L. Gensler

*Attorney, Agent, or Firm*—William T. O'Neil

[57] ABSTRACT

An improved and modified hybrid-ring coupler using distributed, quarter-wave length, tuning element to achieve the proper phasing between signal paths. Extra line lengths have been added to accommodate the addition of a third port so the device is a three-way combiner/divider. Two isolation ports accommodating external isolation resistors are provided. Instrumentation is preferably in microstrip medium.

7 Claims, 12 Drawing Figures

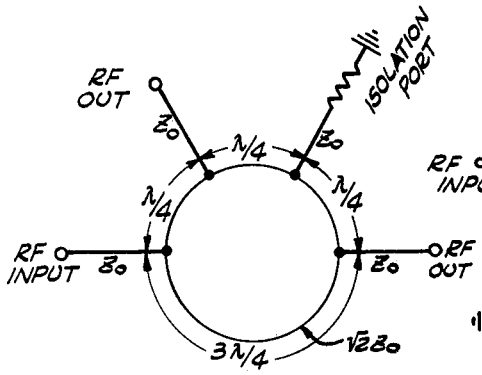
FIG. 1A
HYBRID RING COUPLER
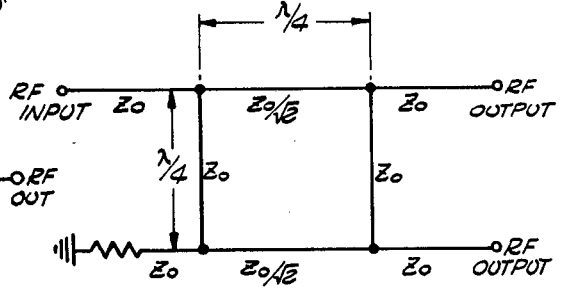
FIG. 1B
BRANCH LINE COUPLER
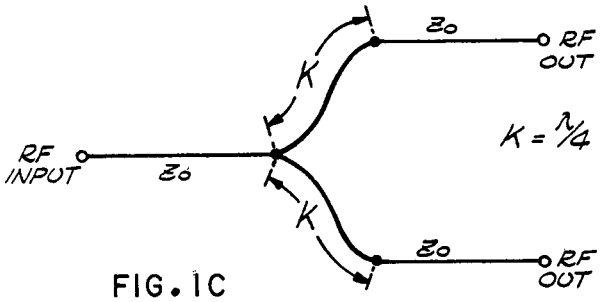
FIG. 1C
IN-LINE CONFIGURATION
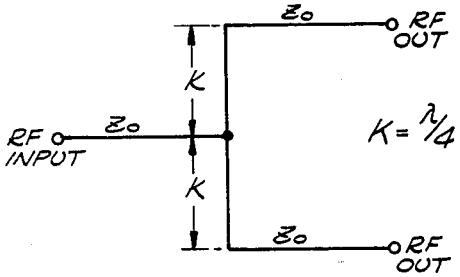
FIG. 1D
TEE CONFIGURATION
FIG. 1E
WILKINSON CIRCUIT
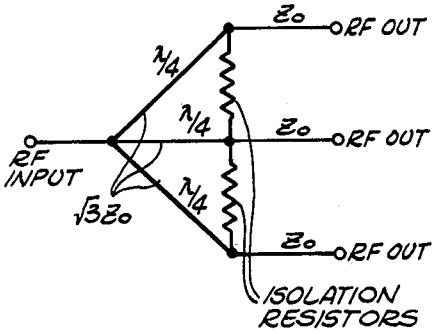
FIG. 1
PRIOR ART

SCHEMATIC REPRESENTATION OF 3-WAY COMBINER / DIVIDER

PRINTED CIRCUIT OF 3-WAY COMBINER / DIVIDER

THREE-WAY, EQUAL-PHASE COMBINER/DIVIDER NETWORK ADAPTED FOR EXTERNAL ISOLATION RESISTORS

BACKGROUND OF THE INVENTION

The invention applies generally to microwave power combiner/divider devices, particularly for use in microwave transmitting and receiving systems.

DESCRIPTION OF THE PRIOR ART

In the past the power combiner/divider function has been achieved by conventional and well-known methods which include the hybrid-ring coupler, the branch-line coupler, in-line power splitter, the tee-combiner/divider and the so-called Wilkinson combiner/divider. Neither the in-line nor tee configuration provides isolation resistors. Therefore, no provision exists for maintaining a reasonable impedance match should one of the several sources whose powers are combined through the device fail. Accordingly, in applications such as those in which several solid-state, microwave, power generator sources are to have their outputs combined to achieve a higher transmittable power, the capability for continued operation can be quite important. For example, such an arrangement might be employed at an unattended or minimally attended site. Although solid-state, microwave, power generators offer an inherent capability for providing very long life, they are not generally available in more than moderate power ratings. Accordingly, the need arises for combining the output of several such generators to achieve a sufficient overall output. For such applications, the in-line and tee combiner/divider configurations can be ruled out because of the absence of operational capability with a branch source failure.

Both the branch-line and hybrid-ring configurations have appropriate isolation resistors and consequent capability for at least partial failed source isolation, but neither of these has the capability of dividing by three or combining three sources at one output.

The so-called Wilkinson circuit, on the other hand, has both isolation resistors and the capability of multiple division and combination. However, the isolation resistors must be internally mounted. The result of integrating the resistors internally into the strip-line structure is that, when large resistors are employed to handle the rated RF power, excessive parasitic capacitance is introduced and the resultant insertion loss is prohibitively high.

The manner in which the present invention deals with the disadvantages and limitations of the prior art to provide a novel solution to the problem of "times-three" division and combining will be evident as this description proceeds.

SUMMARY

According to the invention, a modified form of hybrid-ring coupler is provided using distributed, quarter-wave length tuning elements to achieve the proper phasing between signal paths. Unlike the familiar hybrid ring, extra line lengths are provided so that three output ports and a common or input port are provided in addition to two isolation ports. The device is inherently reciprocal, a signal at the input or common port being split three ways, substantially one-third of the power appearing at each of the three output ports. Associated line lengths between the various ports are adjusted such that signals are in-phase at the output ports and cancel at the isolation ports. Accordingly, the divided energy appears in equal phase as well as equal amplitude.

When used as a combiner, three signals of equal phase and amplitude are assumed to be applied to the three output ports, these signals adding in-phase at the input or common port and again cancelling at the isolation ports. The result is efficient combination of received signals at the common port.

The details of a typical embodiment of the present invention implemented in microstrip will be described as this description proceeds.

BRIEF DESCRIPTION OF THE DRAWINGS

FIG. 1A is a prior art hybrid-ring coupler.

FIG. 1B is a branch-line coupler combiner/divider as also known in the prior art.

FIG. 1C depicts the so-called in-line configuration of a combiner/divider as also known in the prior art.

FIG. 1D depicts the prior art tee configuration.

FIG. 1E represents the so-called Wilkinson circuit according to its known configuration.

DETAILED DESCRIPTION

As indicated hereinbefore, FIGS. 1A through 1E are included for background, since those figures describe prior art configurations. Some of the disadvantages and limitations in respect to each of these prior art devices are set forth herein under the description of the prior art. The skilled practitioner in this art will recognize each of these prior art devices, no detailed description of them being necessary.

Figure 2:
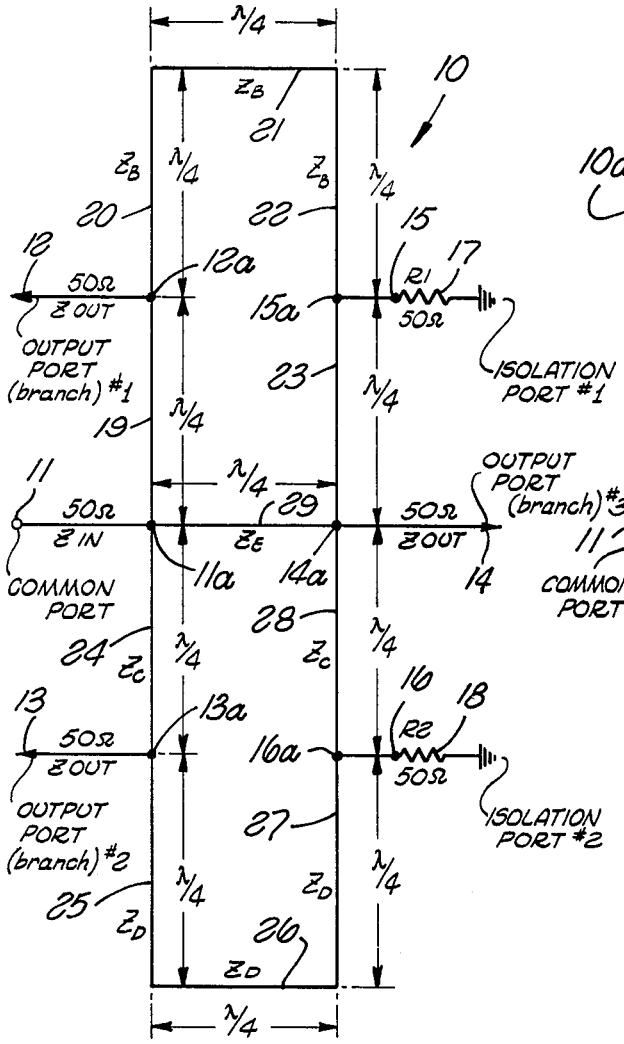
FIG. 2 is a schematic representation of a three-way combiner/divider according to the invention.

Referring to FIG. 2, it will be noted that a schematic representation of a three-way combiner/divider according to the invention is depicted. The invention can be implemented in a layout duplicating the showing of FIG. 2. However, the physically more convenient configuration of FIG. 3 would be preferred for most applications.

Figure 3:
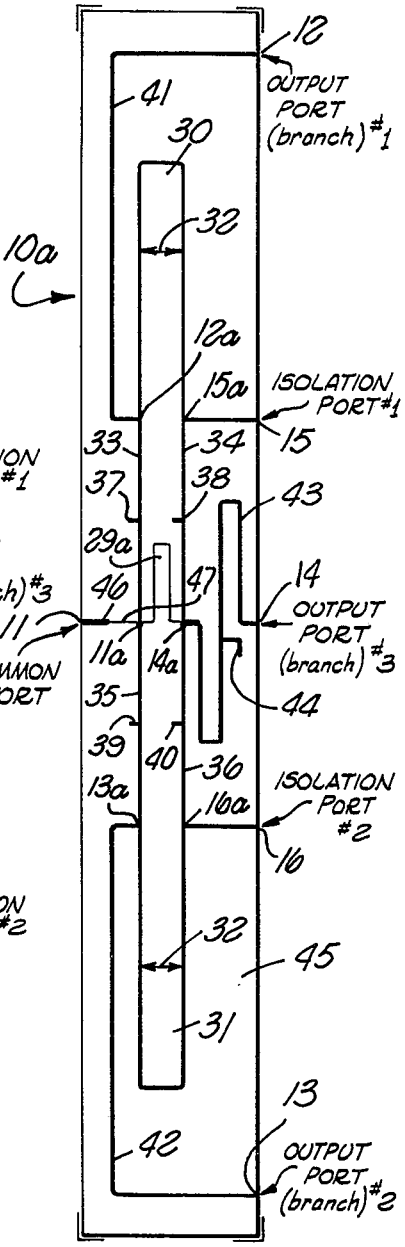
FIG. 3 depicts a typical printed circuit (microstrip) instrumentation of a three-way combiner/divider according to the invention.
Figure 4A:
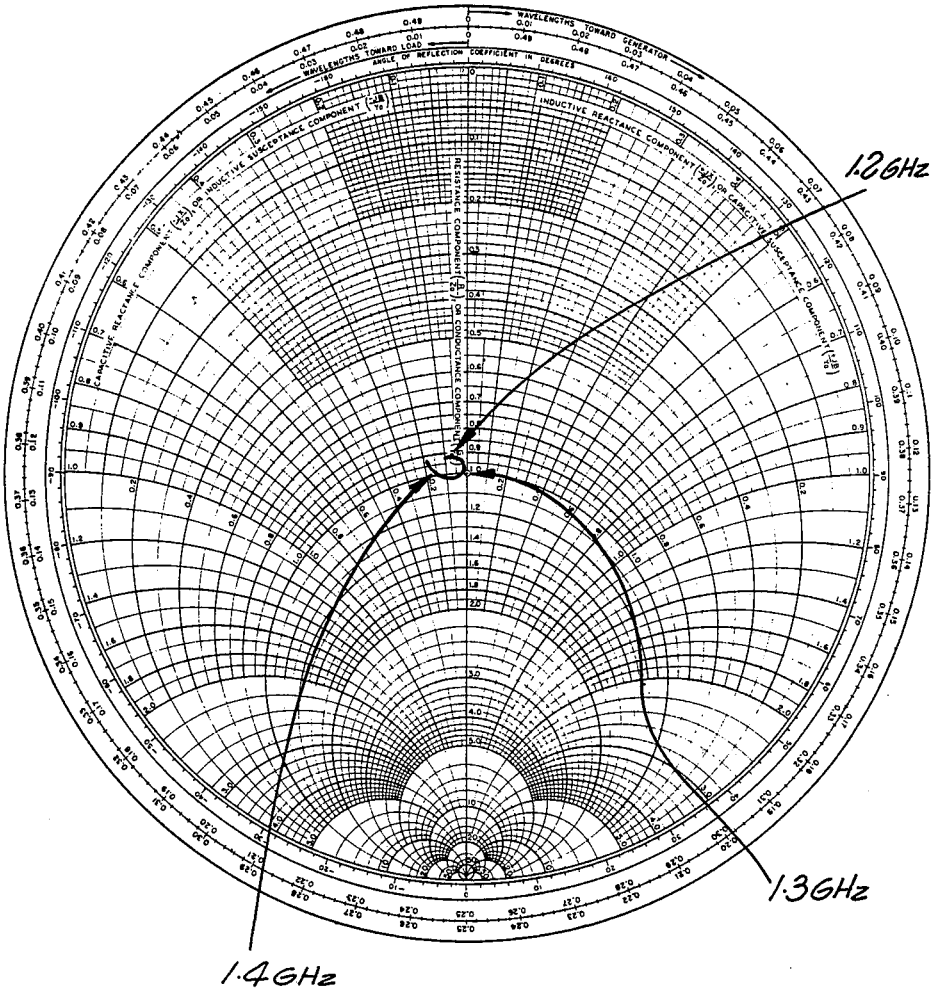
FIG. 4A is a Smith chart plot of the voltage standing wave ratio extant at the common port of a typical embodiment of the invention constructed in accordance with FIG. 3.
Figure 4B:
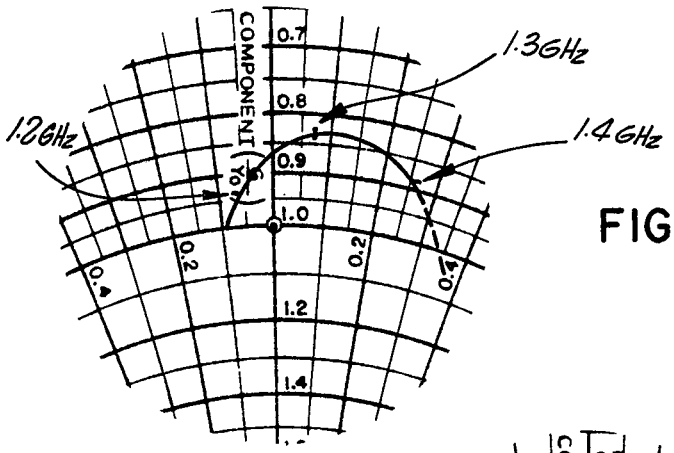
FIGS. 4B, 4C and 4D are "Smith charts" depicting the VSWR's of ports 1, 2 and 3, respectively, of FIG. 3.
Figure 4C:
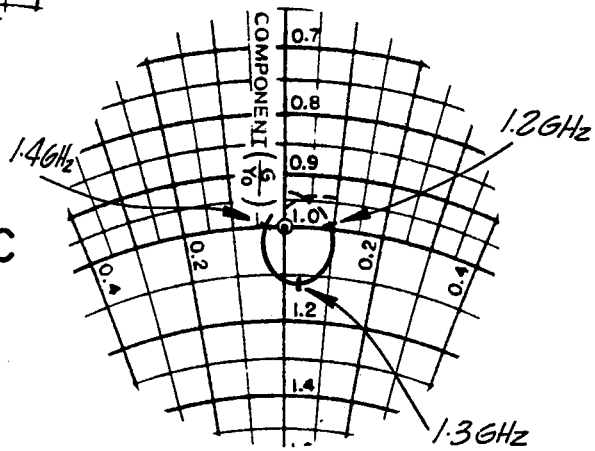
Figure 4D:
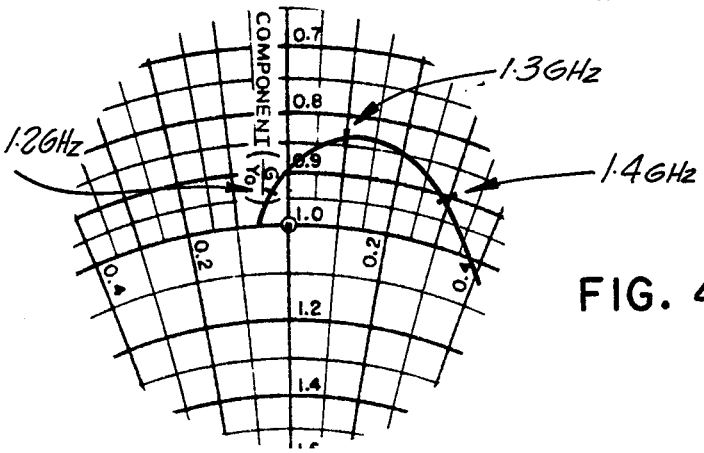

In describing FIG. 2, and for that matter, FIG. 3, it will be assumed that the device is being used as a power divider, although it is to be understood that it is entirely reciprocal and therefore capable of combining signals applied at the outputs (branches) into a signal which has a magnitude equal to the sum of those applied at the three output terminals minus a minimal amount of inherent loss.

In FIG. 2, the input terminal 11 will be considered to be the power input, this being directly connected with junction 11A. Point 11 will be referred to as the common (or input) port. The three output or branch junctions, #1, #2 and #3 are identified as 12A, 13A and 14A, respectively. The respective output ports are 12, 13 and 14.

The difference between the ports and junctions in the terminology chosen is the length of printed conductor required to reach the edge of the substrate. In the embodiment of FIG. 3, it was desired to place all of the outputs (branches) on the same side of the substrate.

Continuing now with the description of FIG. 2, the schematic representation generally depicted at 10 is capable of being implemented in any of several microwave transmission line media. For example, stripline, microstrip, coaxial line, or even waveguide might be used, although the latter would be quite inconvenient and cumbersome.

The aforementioned input or common port is depicted at 11, this connecting directly with appropriate impedance match to the input or common port junction 11A. From 11A, three separate quarter-wave transmission line sections extend; i.e., 19 connecting to the junction 12A corresponding to output port #1 at 12; 29 connecting from junction 11A to junction 14A, the latter corresponding to output (branch) port #3 at 14; and quarter-wave transmission line section 24 which connects from junction 11A to junction 13A, the latter corresponding to output (branch) port #2 at 13. A three-quarter wave transmission line comprised of three quarter-wave sections in series connects the junction 12A to junction 15A, these individual quarter-wave sections being 20, 21 and 22. Junction 15A will be seen to correspond to isolation port #1 at 15. Similarly, a three-quarter wavelength line comprising quarter wave sections 25, 26 and 27 extends from junction 13A to junction 16A, the latter corresponding to the second isolation port 16. Two additional quarter-wave sections 23 and 28 connect from junction 14A to junctions 15A and 16A respectively. External isolation resistors 17 and 18 are connected to isolation ports 15 and 16, respectively. As previously indicated, the inherent capacitive effects introduced by resistors of relatively large power rating at 17 and 18 have substantially no effect in the circuit of FIG. 2, unlike prior art configurations.

Referring now to FIG. 3, a more practical implementation of the circuit of FIG. 2 in microstrip medium is illustrated generally at 10A. The microstrips are, in fact, printed circuit conductors on a substrate 45 of known type. The junctions identified as 11A, 12A, 13A, 14A, 15A and 16A are depicted in both FIG. 2 and FIG. 3 for clarity. Quarter-wave sections 33, 34, 35 and 36 on FIG. 3 are equivalent to 19, 23, 24 and 28, respectively, on FIG. 2. The three-quarter wave sections which comprises 20, 21 and 22 on FIG. 2 is shown at 30 on FIG. 3, and likewise, 31 on FIG. 3 is equivalent to quarter-wave sections 25, 26 and 27 in series as depicted on FIG. 2.

The configuration of the printed conductors which comprise the transmission line sections on FIG. 3 is compressed in the dimensional normal to the length of the elongated substrate 45 for the sake of space efficiency. Notwithstanding that, the three-quarter wave sections 30 and 31 present the same length between their connected junctions as was the case with their equivalent transmission line sections from FIG. 2. Similarly, the quarter-wave section 29A, corresponding to 29 on FIG. 2, is folded as illustrated on FIG. 3, essentially for the same space accommodation reason.

To be consistent with the input and output impedances of FIG. 3, the input impedance at the common (input) port 11 is assumed to be 50 ohms and accordingly, lead 46 is depicted as a 50 ohm section with gradual or step-wise transition to approximately 62½ ohms at 47 in order to match the junction 11A. The folded quarter-wave section 29A is printed with a characteristic impedance of 86 ohms (approximately) and quarter-wave sections 33, 34, 35 and 36 are printed with a 70.7 ohm characteristic impedance. In speaking of the impedance of a printed circuit line in microstrip medium, it is noted that the printed conductor width determines this in a manner well-known to those of skill in this art. In general, the heavier lines, as indicated on FIG. 3, are those of lower characteristic impedance than is the case with the narrower lines.

From the foregoing, it will be realized that the impedance presented at 11A, 12A, 13A, 14A, 15A and 16A are all substantially 50 ohms in accordance with the original assumptions, and the output leads 41, 42 and 43 are equal length 50 ohm sections so that phase disparities are not introduced between the output ports at 12, 13 and 14.

Compensating stubs 37, 38, 39, 40 and 44 are shown, and it is to be understood that these are compensating stubs which may or may not be necessary depending upon the precision with which the apparatus is constructed. The basic function of those stubs is to compensate for small transmission line section path length errors.

It will be realized, of course, that in the microstrip medium, the insulating substrate 45 is backed (beneath the substrate 45) by a conductive ground plane according to the well-known microstrip construction technique. Typical materials for the insulating substrate include Teflon fiber-glas and alumina. Such substrate materials exhibit low tangential loss and are readily fabricated to provide a uniform dielectric constant. The printed conductors illustrated on FIG. 3 may be copper strips unless the substrate material is alumina, in which case gold is the much preferred conductor material.

The quarter-wave and three-quarter wave dimensions referred to in the aforementioned description are to be understood to be those prescribed wave lengths in the medium (rather than in free space).

A typical device constructed in accordance with FIG. 3 operates in the 1.2 to 1.4 GHz region with a peak power on the order of one kilowatt. Microstrip implementation, however, is capable of powers up to 25 kilowatts, provided the strip-to-connector interface design is adequate. The relatively large (in power rating) resistors 17 and 18 can easily be conservatively selected. That is, they may be capable of higher power than is actually required, this adding to the overall reliability and low failure probability.

In the folded strip configuration of FIG. 3, the dimension 32 need not be, and in fact is obviously less than, one-quarter wavelength, however the total lengths of 30 and 31 are each three-quarter wavelength.

As previously indicated, other transmission line media could be used for the construction of the apparatus of the invention. Although microstrip is to be considered the preferred medium, provided the power levels are not higher than approximately 25 kilowatts peak, the so-called strip line in which the conductors are sandwiched between two parallel space ground plans, is probably the second most convenient medium.

In FIGS. 4A, 4B, 4C and 4D, Smith Charts depict typical measured VSWR plots for three frequencies (1.2, 1.3 and 1.4 GHz) for the common (input) port 11, output (branch) port #1 (12), output port #2 (13) and port #3 (14), respectively. These values apply to the configuration of FIG. 3.

Figure 5:
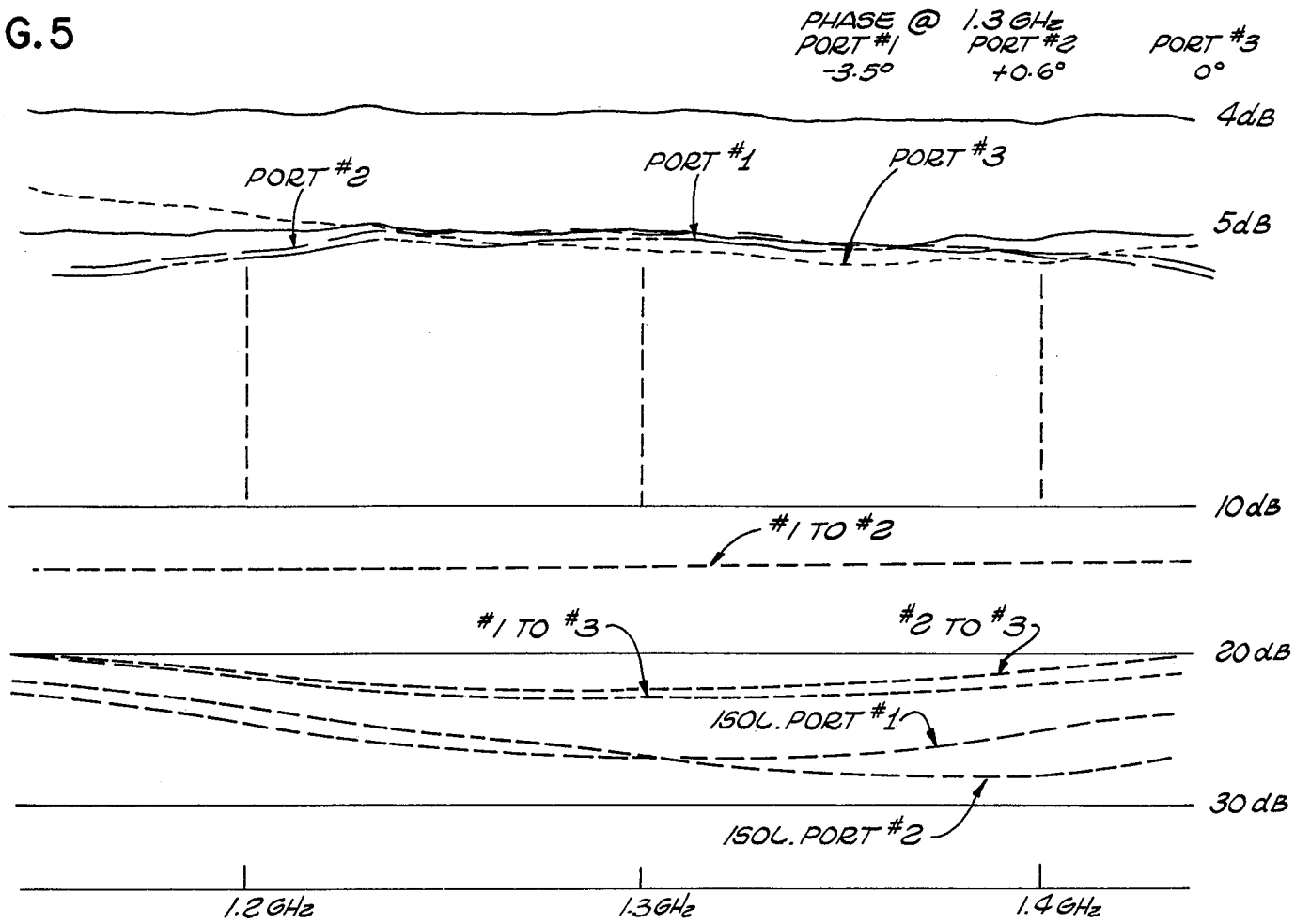
FIG. 5 presents a selected group of measured performance characteristics for a typical implementation of the invention as shown in FIG. 3.

In FIG. 5, coupling values with respect to the input (common) port are shown for the three output ports, as identified. Coupling between output ports is also presented; i.e., ports #1 to #2, #1 to #3 and #2 to #3 as identified. Still further, the isolation port couplings with respect to the common port are depicted.

In respect to the output port couplings, the theoretical optimum (zero loss) value would be determined by the relationship 10 Log 1/N, where N is 3, corresponding to the three-way split provided. This theoretical value is 4.77 db. However, in view of unavoidable losses in a practical device, the actual coupling values shown on FIG. 5 fall just below 5 db.

Other modifications and variations will suggest themselves to those of skill in this art once the principles of the present invention are appreciated. Accordingly, it is not intended that the drawings of this description should be considered as limiting the scope of the invention, the drawings and this description being intended to be typical and illustrative only.

What is claimed is:

1. A three-way microwave power combiner/divider comprising:

a common port and first, second and third branch ports;

first and second isolation ports;

common, first, second and third junctions and first and second isolation junctions each connected to a corresponding one of said ports;

first means comprising a first quarter-wave transmission line section connected from said common junction to said first junction, a second quarter-wave transmission line section connected from said common junction to said second junction, and a third quarter-wave transmission line section connected from said common junction to said third junction;

second means comprising a first three-quarter wavelength transmission line section connected from said first junction to said first isolation junction and a second three-quarter wavelength transmission line section connected from said second branch junction to said second isolation junction;

third means comprising a fourth quarter-wave transmission line section connected from said third junction to said first isolation junction and a fifth quarter-wave transmission line section connected from said third branch junction to said second isolation junction;

and first and second external isolation resistors connected discretely to said first and second isolation ports, respectively, and means connecting said first and second isolation ports to said first and second isolation junctions, respectively.

2. Apparatus according to claim 1 in which said three-quarter wavelength sections are each composed of plural quarter-wavelength sections in series and are physically folded to accommodate the geometry between said common port and said branch and isolation ports.

3. Apparatus according to claim 1 in which said combiner/divider is implemented in microstrip, said first, second and third means comprising printed conductors on an insulating substrate.

4. Apparatus according to claim 3 in which said three-quarter wavelength transmission line sections each comprise a U-shape conductor pattern with two generally parallel legs spaced not more than one-quarter wavelength.

5. Apparatus according to claim 1 in which said combiner/divider is implemented in microstrip, said transmission line sections of said first, second and third means being printed conductors on an insulating substrate in an elongated configuration in which said first and second transmission line sections are colinear along a first printed conductor line and said fourth and fifth transmission line sections are colinear along a second printed conductor line substantially parallel to said first line, and in which said first and second printed conductor lines are laterally spaced by less than one quarter wavelength, said third transmission section being folded to provide a quarter-wavelength path.

6. Apparatus according to claim 5 in which said three-quarter wavelength transmission line sections are each an elongated, U-shape printed circuit line having a length greater than one quarter wavelength and a width substantially equal to said lateral spacing between said first and second printed conductor lines.

7. Apparatus according to claim 6 in which said first, second and third junctions are each extended to a corresponding port along the same edge of said substrate, said extensions being folded as required to effect equal path lengths from each of said junctions to a corresponding port.

* * * * *